US008104489B2

(12) United States Patent
Kim et al.

(10) Patent No.: US 8,104,489 B2
(45) Date of Patent: Jan. 31, 2012

(54) DISHWASHER

(75) Inventors: Min Chul Kim, Gyeongsangnam-do (KR); Tae Hwan Cho, Busan (KR); Hong Ki Kang, Busan (KR)

(73) Assignee: LG Electronics Inc., Seoul (KR)

( * ) Notice: Subject to any disclaimer, the term of this patent is extended or adjusted under 35 U.S.C. 154(b) by 351 days.

(21) Appl. No.: 11/862,033

(22) Filed: Sep. 26, 2007

(65) Prior Publication Data

US 2008/0173338 A1 Jul. 24, 2008

(30) Foreign Application Priority Data

Sep. 27, 2006 (KR) ..... 10-2006-0093859

(51) Int. Cl.
*B08B 3/02* (2006.01)

(52) U.S. Cl. ..... 134/184; 134/186

(58) Field of Classification Search ..... 134/186, 134/184

See application file for complete search history.

(56) References Cited

U.S. PATENT DOCUMENTS 1,583,710 A * 5/1926 Welch ..... 134/174
1,690,974 A * 11/1928 Hazard et al. ..... 134/176
2,287,927 A * 6/1942 Altorfer ..... 68/23.5
3,272,129 A * 9/1966 Leopold ..... 417/350
3,416,454 A * 12/1968 Dowdican ..... 415/147
3,664,759 A * 5/1972 Bieheller ..... 415/147
3,680,784 A * 8/1972 Fakes ..... 239/126
3,810,480 A * 5/1974 Smith et al. ..... 134/104.1
3,847,666 A * 11/1974 Jacobs ..... 134/57 D
4,091,644 A * 5/1978 Bochan ..... 68/18 F
4,612,947 A * 9/1986 Duncan ..... 134/104.1
4,818,177 A * 4/1989 Grohmann ..... 415/49
4,833,900 A * 5/1989 Babuin et al. ..... 68/18 F
5,450,868 A * 9/1995 Young, Jr. ..... 134/111
5,500,113 A * 3/1996 Hartley et al. ..... 210/321.6
5,924,432 A * 7/1999 Thies et al. ..... 134/56 D
6,234,184 B1 * 5/2001 Tuller et al. ..... 134/104.1
7,252,101 B2 * 8/2007 Elick et al. ..... 134/111
2006/0060222 A1 * 3/2006 Park et al. ..... 134/56 D
2006/0060225 A1 * 3/2006 Han et al. ..... 134/56 D
2006/0118146 A1 * 6/2006 Deog Jeong et al. ..... 134/56 D

FOREIGN PATENT DOCUMENTS

JP 2004-052664 * 2/2004

* cited by examiner

*Primary Examiner* — Frankie L Stinson
(74) *Attorney, Agent, or Firm* — Birch, Stewart, Kolasch & Birch, LLP

(57) ABSTRACT

Provided is a dishwasher. The dishwasher includes a sump case forming a space to store wash liquid, and a drain pump provided at one side of the sump case. The drain pump includes a drain impeller that induces a flow of wash liquid, and a plurality of mutually separable cases covering the drain impeller.

9 Claims, 7 Drawing Sheets

DISHWASHER

CROSS-REFERENCE TO RELATED APPLICATIONS

The present disclosure relates to subject matter contained in priority Korean Application No. 10-2006-0093859, filed on Sep. 27, 2006, which is herein expressly incorporated by reference in their entirety.

BACKGROUND

The present disclosure relates to a dishwasher.

A dishwasher is a household appliance that removes impurities such as food residue from dish surfaces using wash liquid.

A dishwasher includes a tub that forms a wash chamber, a sump installed at the bottom of the tub to store wash liquid, a wash pump installed within the sump for pumping wash liquid, spray arms/nozzles provided within the tub for spraying wash liquid, withdrawable dish racks installed in the tub to store dishes, and a drain pump for draining dirty water from within the sump.

Wash liquid flowing to the spray arms/nozzles by the pumping action of the wash pump is sprayed at high pressure through spray holes formed in the spray arms/nozzles. The wash liquid sprayed at high pressure collides against surfaces of dishes stored within the tub, so that food residue and other impurities on the dishes fall to the floor of the tub. In this way, dishes stored within the dish racks are washed. Then, the wash liquid containing impurities that enters the sump is drained to the outside by the drain pump.

However, in a related art drain pump, the housing holding the drain impeller is formed integrally with the sump case, so that it is difficult to clean the inside of the drain pump.

When the inside of the drain pump is not properly cleaned, the drain pump can become clogged.

SUMMARY

Embodiments provide a dishwasher. A dishwasher according to embodiments includes a sump case forming a space to store wash liquid, and a drain pump provided at one side of the sump case. The drain pump includes a drain impeller that induces a flow of wash liquid, and a plurality of mutually separable cases covering the drain impeller.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
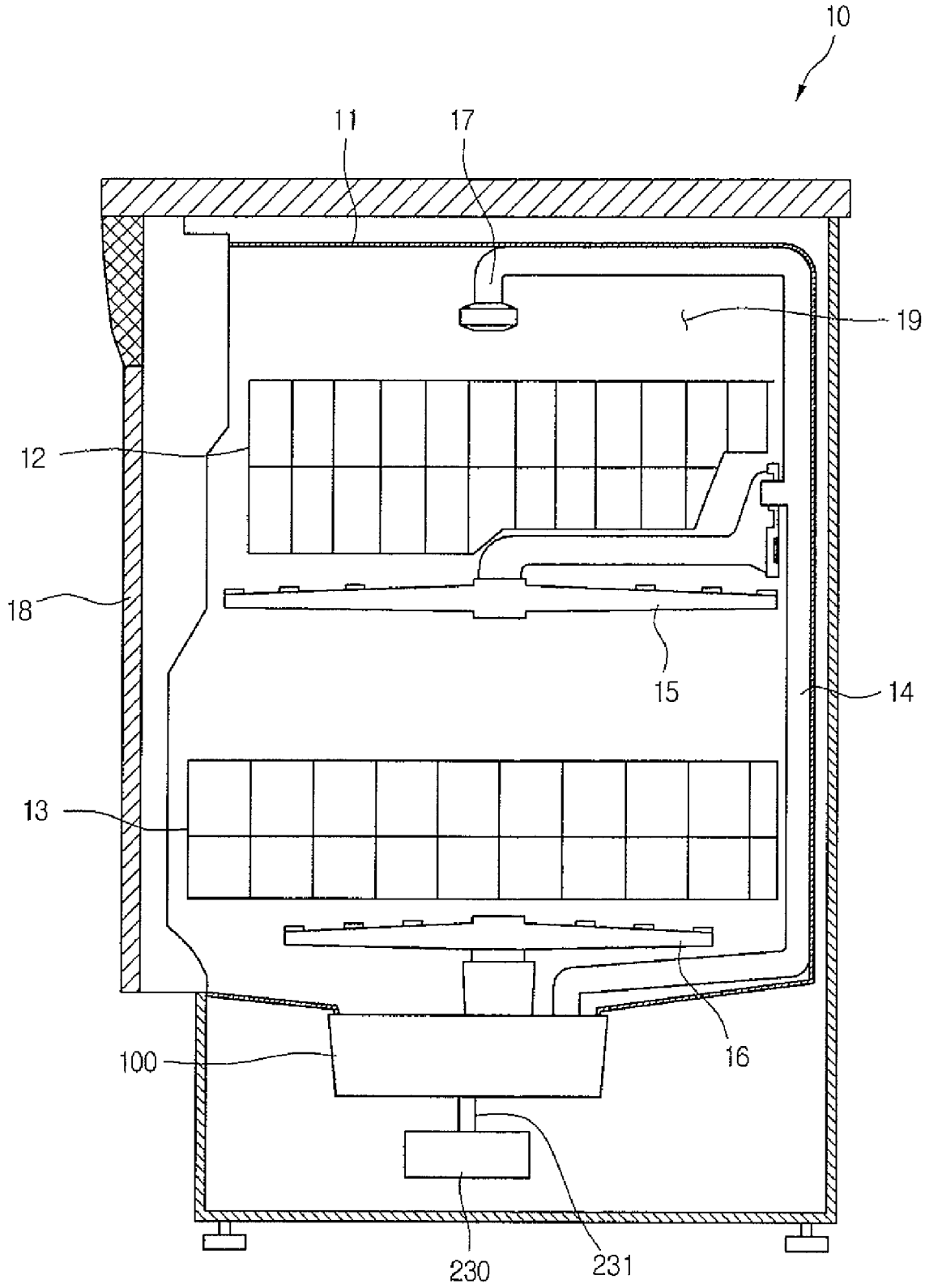
FIG. 1 is a sectional view of a dishwasher according to the present embodiments.

FIG. 1 is a sectional view of a dishwasher according to the present embodiments.

Referring to FIG. 1, a dishwasher 10 according to the present embodiments includes a tub 11 forming a wash chamber 19, a door 18 provided at the front of the tub 11 to open and close the wash chamber 19, a sump 100 provided at the bottom of the tub 11 for storing wash liquid, and dish racks 12 and 13 provided within the tub for storing dishes.

The dishwasher 10 also includes a wash motor 230 installed at the bottom of the sump 100 to drive a wash pump (described below) that is installed within the sump 100, a water guide 14 coupled at the top of the sump to function as a passage for the wash liquid pumped by the wash pump 230, a lower spray arm 16 coupled at the top of the sump 100 to spray wash liquid in an upward direction, an upper spray arm 15 selectively coupled at the upper part of the water guide 14, and a top nozzle 17 located near the ceiling of the tub 11 to spray wash liquid downward.

In detail, the dish racks 12 and 13 consist of an upper rack 12 and a lower rack 13. The dish racks 12 and 13 slide forward and backward within the tub 11.

The upper spray arm 15 is disposed below the upper rack 12, and the lower spray arm 16 is disposed below the lower rack 13.

Below, a description of the operation of the above dishwasher 10 will be given.

A user first pulls the door 18 to open the wash chamber 19. Then the user pulls the upper rack 12 and/or the lower rack 13 outward from the wash chamber 19. Next, dishes are placed in the upper rack 12 and/or lower rack 13, after which the upper rack 12 and/or lower rack 13 is pushed back into the wash chamber 13 and the door 18 is closed to seal the wash chamber 19.

Then, a power button is pressed to supply power to the dishwasher 10.

When power is supplied to the dishwasher 10, a wash course is begun. When the wash course is performed, wash liquid flows into the sump 100 through a water supply inlet. After a predetermined amount of wash liquid enters the sump 100, the wash motor 230 operates. A motor shaft 231 connected to the wash motor 230 rotates, and an impeller 151 (in FIG. 3) connected to the motor shaft 231 also rotates, prompting a flow of wash liquid to the upper spray arm 16 and the water guide 14. The wash liquid that flows to the water guide 14 is sprayed through the top nozzle 17 and the upper spray arm 15 into the wash chamber 19. The thus sprayed wash liquid washes surfaces of dishes stored in the upper rack 12 and/or the lower rack 13.

In detail, the top nozzle 17 sprays wash liquid downward, the upper spray arm 15 sprays wash liquid upward, and the lower spray arm 16 sprays wash liquid upward.

Dirty water that collects in the sump 100 is filtered of impurities by a filter (not shown). The filtered wash liquid is discharged to the outside of the dishwasher 10 through a drain pump.

When wash liquid is discharged to the outside, fresh wash liquid enters the sump 100 once more through the water supply inlet, to be sprayed through the spray arms 15 and 16, as in the wash cycle. The dishes are rinsed in a rinse cycle by the clean wash liquid that is sprayed. When the rinse cycle of the dishes is completed, a drying cycle is performed, completing the wash course of the dishwasher 10.

Below, a detailed description of the sump 100 according to the present embodiments is provided.

Figure 2:
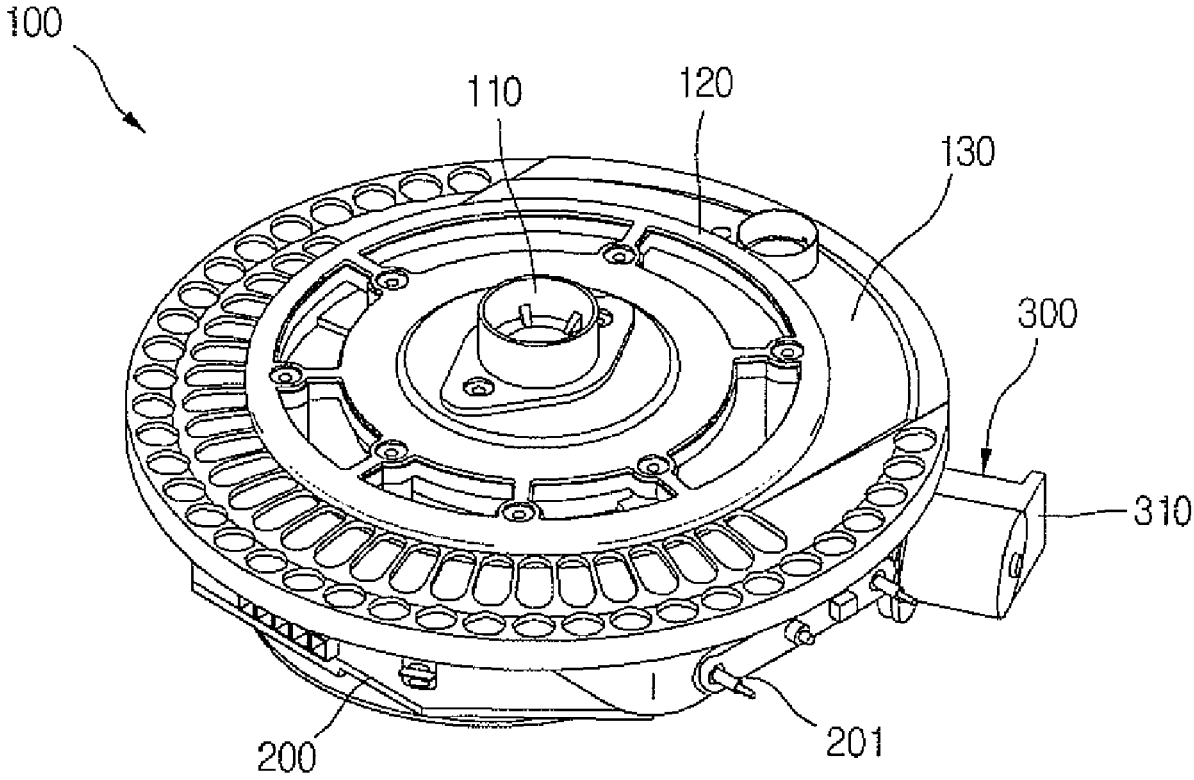
FIG. 2 is a perspective view of a dishwasher sump according to the present embodiments.
Figure 3:
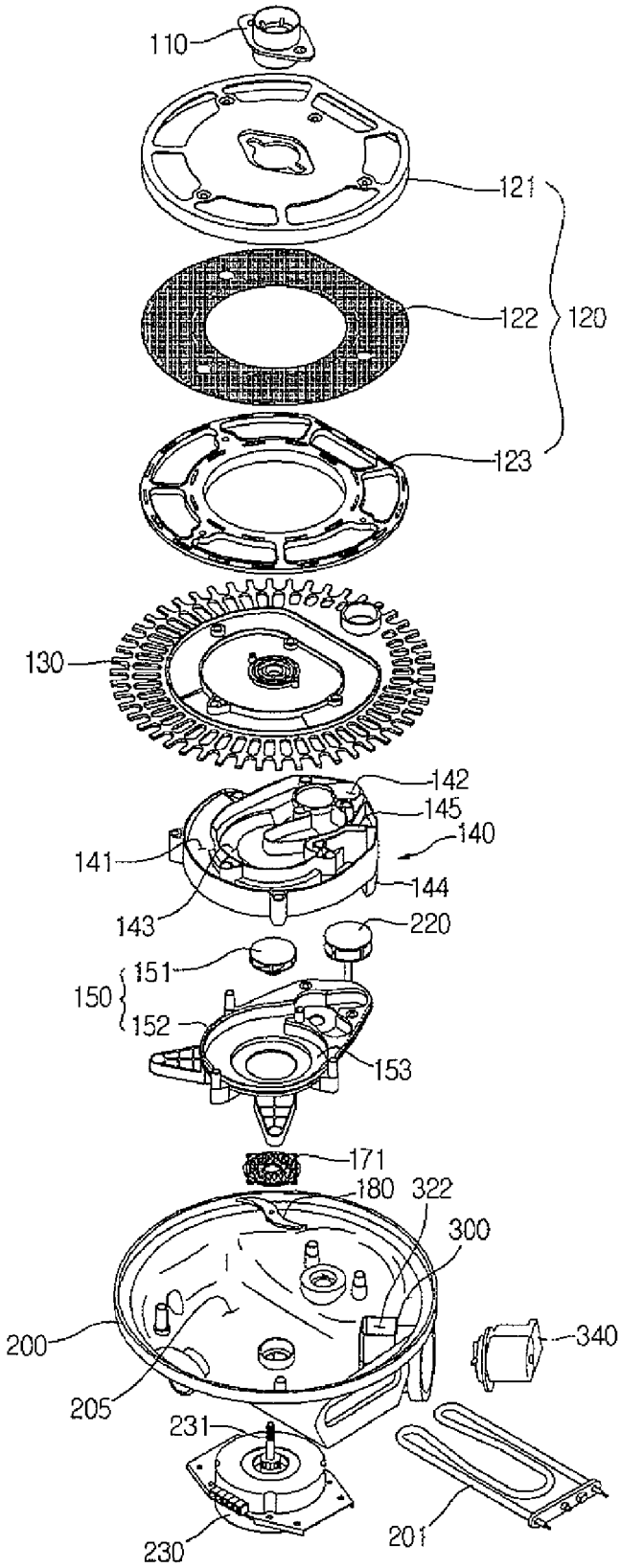
FIG. 3 is an exploded perspective view of a sump according to the present embodiments.

FIG. 2 is a perspective view of a dishwasher sump according to the present embodiments, and FIG. 3 is an exploded perspective view of a sump according to the present embodiments.

Referring to FIGS. 2 and 3, a sump 100 according to the present embodiments includes a sump case 200 forming a wash liquid reservoir 205, a sump cover 130 covering the top of the sump case 200, a lower spray arm holder 110 coupled at the top of the sump cover 130 and connected to the lower spray arm 16, a wash motor 230 installed below the sump case 200 to drive the wash pump 150, a drain pump 300 to discharge wash liquid containing impurities to the outside, and a drain motor 340 that drives the drain pump 300.

The sump 100 also includes a heater 201 inserted through the side of the sump case 200 to be disposed in the wash liquid reservoir 205 for heating wash liquid, a disposer 180 coupled to the shaft 231 of the wash motor 230 for grinding food particles included in wash liquid, a wash pump 150 driven by the wash motor 230 to pump wash liquid stored in the wash liquid reservoir 205, a passage guide 140 disposed between the sump cover 130 and the pump case 170 and in which a soil chamber 141 that collects impurities is formed, and a screen filter provided below the wash pump 150 to prevent food particles ground by the disposer 180 from entering the wash pump 150.

Specifically, the wash pump 150 includes an impeller 151 coupled to the shaft 231 of the wash motor 230, and a wash pump case 152 forming a housing 153 in which the impeller 151 is housed. The wash pump case 152 is coupled to the sump case 200.

A passage control valve 220 is disposed at one end on the top surface of the wash pump case 152, to direct wash liquid pumped by the wash pump 150 alternatingly to the lower spray arm passage 143 and the water guide passage 142 (described below).

Also, wash liquid stored in the wash liquid reservoir 205 passes through the portion in which the screen filter 171 is installed, and is suctioned into the wash pump 150. The suctioned wash liquid flows along the passage formed in the wash pump case 152 to the passage control valve 220.

The passage guide 140 is coupled to the top of the wash pump case 152. A lower spray arm passage 143 and a water guide passage 142 are formed on the passage guide 140 to direct the wash liquid pumped by the wash pump 150 to the lower spray arm 16 and the water guide 14.

Formed at the passage guide 140 are a soil chamber 141 that collects food residue, and a chamber discharge hole 144 that allows wash liquid to drain to a drain guide 322 formed on the drain pump 320 (to be described later).

Wash liquid flowing through a sampling passage 145 formed to communicate with a portion in which the passage control valve 220 is formed flows through a chamber discharge hole 144 and enters the drain guide 322. Then the wash liquid flows through the drain guide 322 and the chamber discharge hole 144 into the soil chamber 141.

Thus, impurities collect in the soil chamber 141. Here, a self-cleaning filter 120 formed on the soil chamber 141 prevents the impurities from entering the tub 11.

The sump cover 130 is mounted on the top surface of the guide passage 140, and exposes the floor of the tub 11. A plurality of holes is formed around the edge of the sump cover 130 to allow wash liquid within the tub 11 to enter the wash liquid reservoir 205.

The self-cleaning filter 120, formed in the approximate center of the sump cover 130, includes an upper supporting plate 121, a mesh filter 122, and a lower supporting plate 123.

In detail, the self-cleaning filter 120 is formed to cover the top of the soil chamber 141, prevents impurities in the soil chamber 141 from leaking into the tub 11, and allows only wash liquid to enter the tub 11. Thus, impurities are prevented from entering the wash chamber 19 by means of the self-cleaning filter 120.

Figure 4:
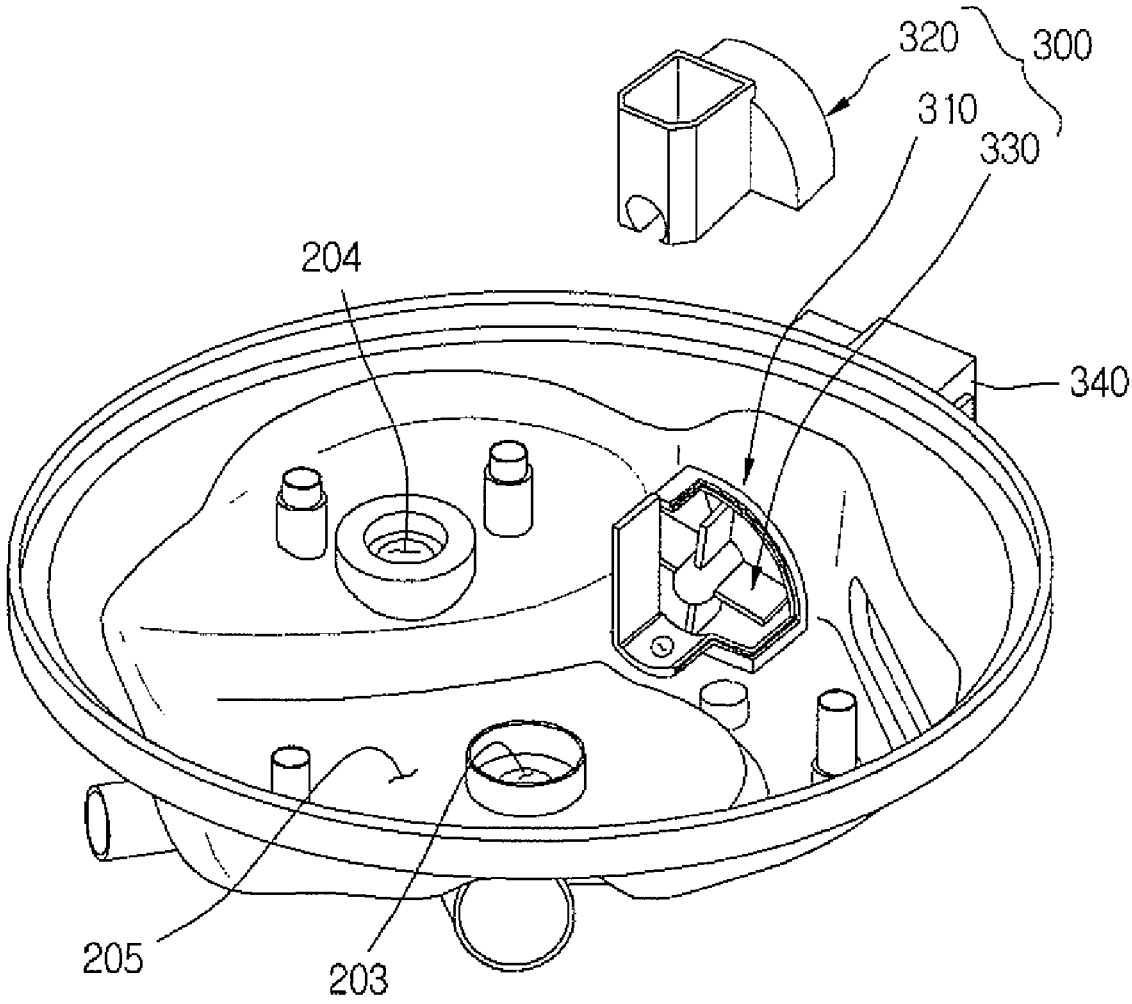
FIG. 4 is a perspective view showing a sump case and a drain pump cover according to the present embodiments.
Figure 5:
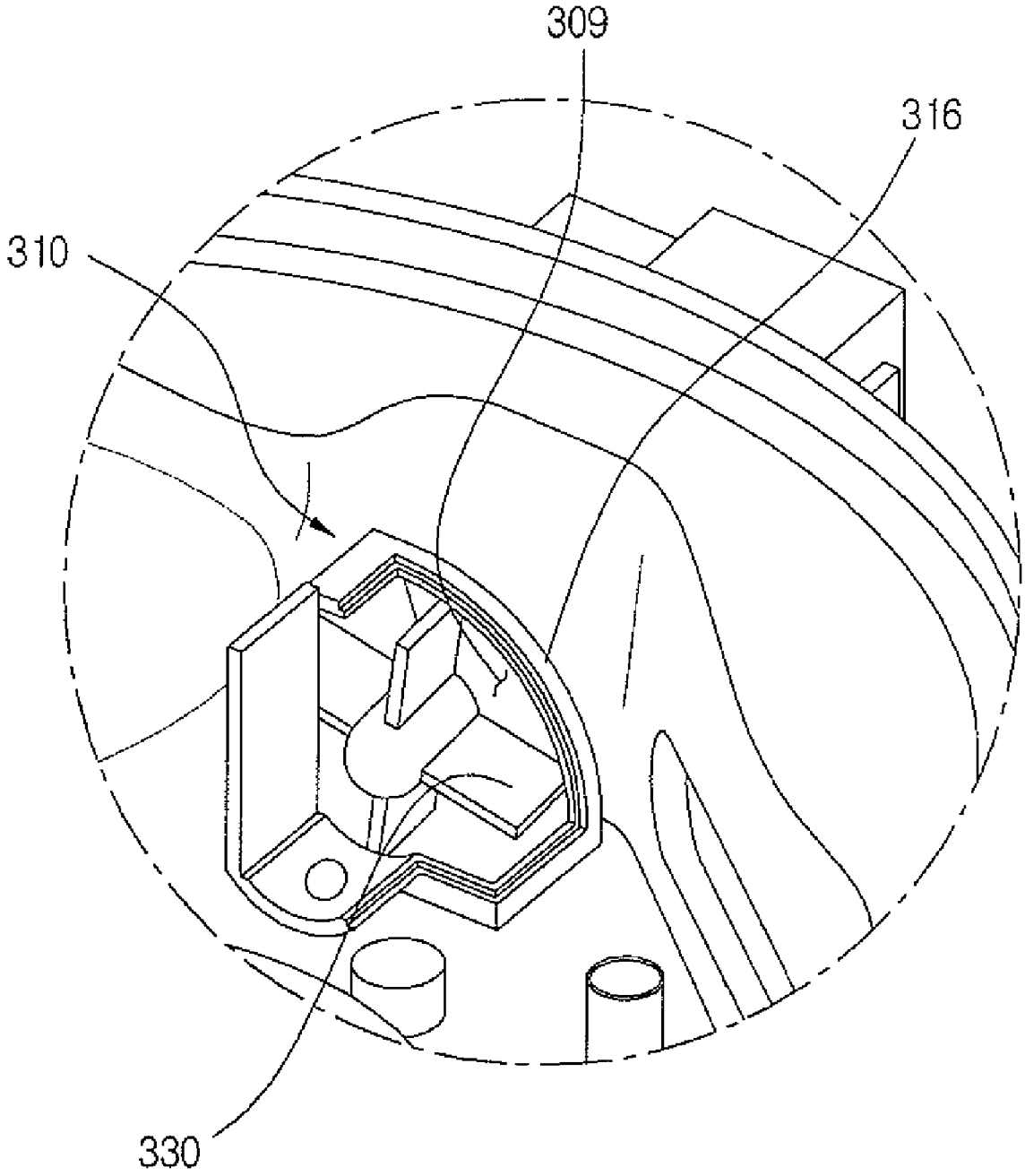
FIG. 5 is a perspective view of a portion of a drain pump according to the present embodiments.
Figure 6:
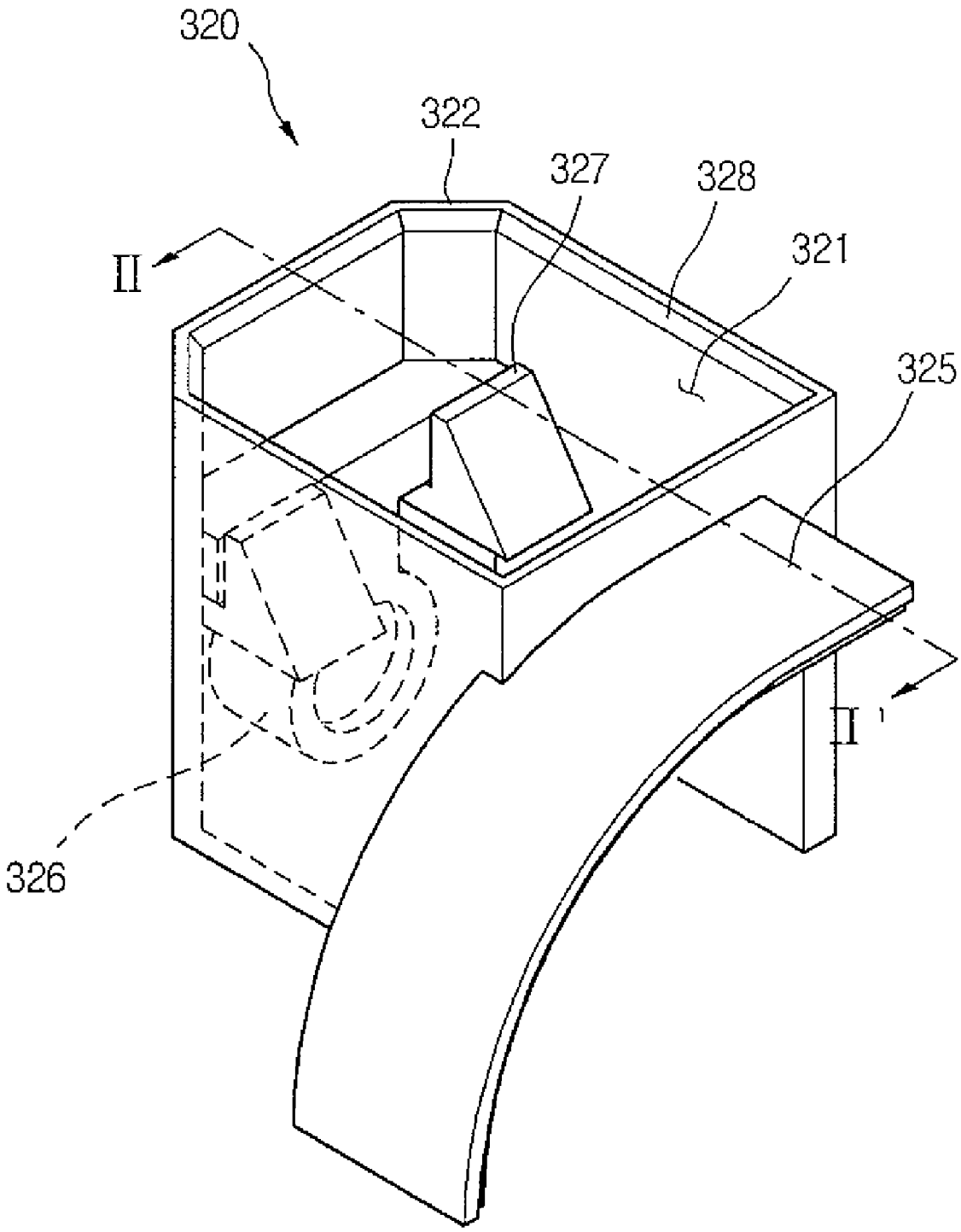
FIG. 6 is a perspective view of a drain pump cover according to the present embodiments.
Figure 7:
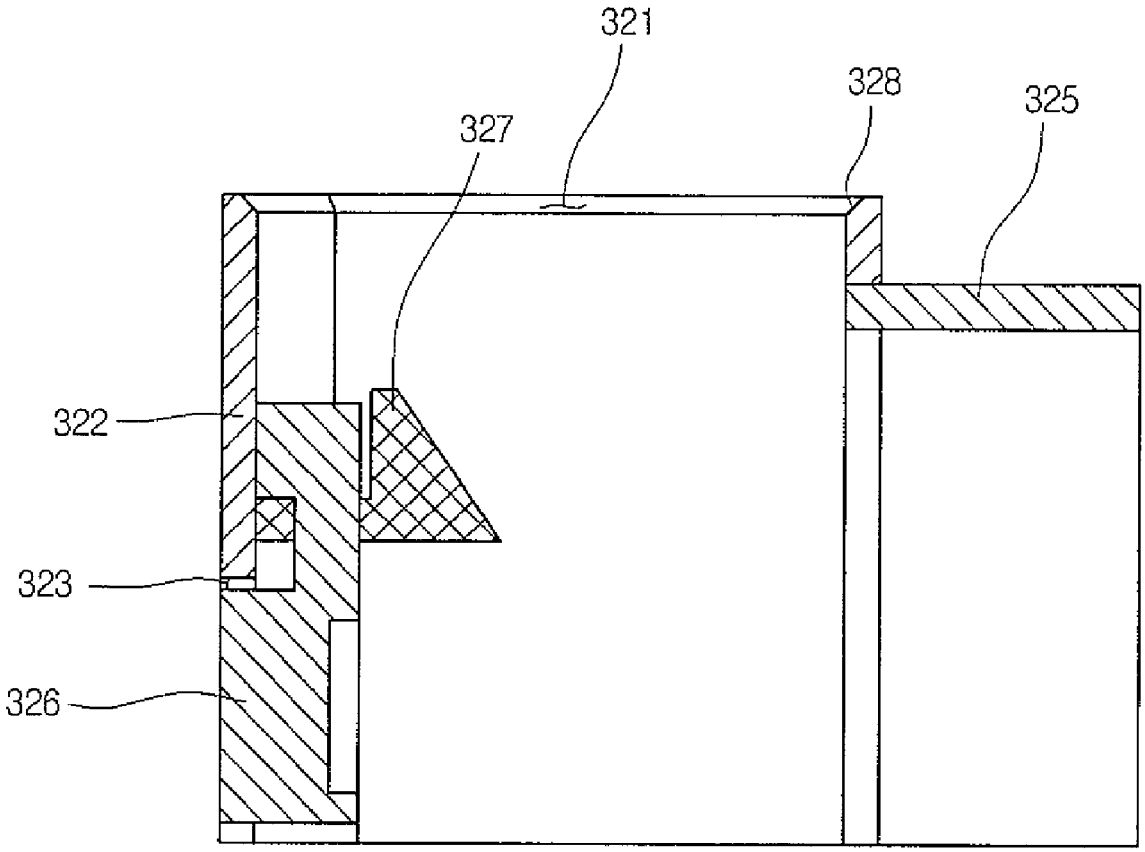
FIG. 7 is a sectional view of FIG. 6 cut along line I-I'.

FIG. 4 is a perspective view showing a sump case and a drain pump cover according to the present embodiments, FIG. 5 is a perspective view of a portion of a drain pump according to the present embodiments, FIG. 6 is a perspective view of a drain pump cover according to the present embodiments, and FIG. 7 is a sectional view of FIG. 6 cut along line I-I'.

Referring to FIGS. 4 through 7, the sump case 200 includes the wash liquid reservoir 205, and the drain pump 300 provided at one side of the wash liquid reservoir 205.

Specifically, a motor shaft through-hole 203 is formed at the center of the wash liquid reservoir 205 for the shaft 231 of the wash motor 230 to pass through. Also, a valve shaft through-hole 204 is formed in another region of the wash liquid reservoir 205 for a shaft operating the passage control valve 220 to pass through.

The valve pump 300 includes a drain impeller 330 for draining wash liquid, and a drain pump case 310 and pump cover 320 forming a housing to protect the drain impeller 330.

In detail, the drain pump case 310 is integrally formed with the sump case 200. The drain pump cover 320 is detachably coupled to the drain pump case 310.

A cover mounting portion 316, on which the drain pump cover 320 is mounted, is formed on the drain pump case 310. The cover mounting portion 316 is formed in a stepped manner. The drain pump cover 320 mounted on the cover mounting portion 316 is also stepped to correspond to the cover mounting portion 316. The drain pump case 310 and the drain pump cover 320 are engaged at the respective stepped portions of the drain pump case 310 and the drain pump cover 320.

Thus, when it is necessary to clean the wash pump, a user is able to separate the wash pump cover 320 from the drain pump case 310, and easily clean the inside of the drain pump 310, thereby increasing user convenience.

Also, a drain hole 309 is formed in the sump case 200, through which the drain impeller 330 passes and which allows wash liquid to drain.

The drain pump cover 320 includes an impeller covering portion 325 that encloses the portion above the drain impeller 330, and a drain guiding portion 322 that induces the flow of wash liquid toward the drain impeller 330. The impeller covering portion 325 is rounded.

The drain guiding portion 322 includes an opening 321 open at the top and bottom. When the drain pump cover 320 is mounted on the drain pump case 310, the lower open portion of the drain guiding portion is covered by the drain pump case 310.

A rib home 328 is formed in the upper edge of the drain guiding portion 322 to couple with a rib (not shown) formed on the chamber discharge hole 144.

Also, a wash liquid inlet 323 that allows wash liquid in the wash liquid reservoir 205 to flow into the drain guiding portion 322 is formed on a side of the drain guiding portion 322.

A check valve 326 is also provided on the drain guiding portion 322 to allow wash liquid in the wash liquid reservoir 205 to selectively enter the drain guiding portion 322.

That is, the check valve 326 allows wash liquid in the wash liquid reservoir 205 to flow to the drain guiding portion 322, and prevents the wash liquid and impurities in the drain guiding portion 322 from flowing into the wash liquid reservoir 205. In other words, only when the pressure in the wash liquid reservoir 205 is higher than the pressure in the drain guiding portion 322, does the check valve 326 open the wash liquid inlet 323.

A pair of coupling ribs 327 for coupling the check valve 326 is formed on the drain guiding portion 322.

Below, the operation of the sump 100 will be described.

First, when a wash course is begun, wash liquid flows from a water supply inlet into the sump case 200. Then, the wash motor 230 rotates the impeller 151.

When the impeller 151 rotates, the wash liquid enters the pump case 170, and the wash liquid that enters the pump case 170 flows to the valve 220.

Next, the wash liquid that flows to the valve 220 flows through the lower spray arm passage 143 and the water guide passage 142 formed on the top surface of the passage guide 140, and into the water guide 14 and the lower spray arm holder 110.

The wash liquid that moves to the water guide 14 and the lower spray arm holder 110 is sprayed through the upper spray arm 15 and the top nozzle 17 or the lower spray arm 16 toward the upper rack 12 and the lower rack 13.

The thus sprayed wash liquid induces food residue deposited on the surfaces of dishes stored in the upper rack 12 and the lower rack 13 to fall to the floor of the tub 11. The wash liquid that falls to the tub floor passes through the plurality of holes formed in the periphery of the sump cover 130, and flows and collects in the wash liquid reservoir 205, to be pumped by the wash pump 150 and re-circulated.

When the draining process is performed, the drain pump 300 operates by means of the drain motor 310, and the wash liquid stored within the sump case 200 is discharged to the outside of the sump 100. Simultaneously, the impurities deposited in the soil chamber 141 pass through the chamber discharge hole 144 and the drain guiding portion 322 to the outside of the sump 100.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a sump case defining a wash liquid reservoir; a wash pump configured to pump wash liquid;

a wash motor configured to drive the wash pump;

a drain pump provided on one side of the sump case; and a drain motor configured to drive the drain pump, the drain motor being provided separately from the wash motor, wherein the drain pump includes:

a drain impeller inducing a flow of wash liquid, the drain impeller passing through a drain hole formed in the sump case;

a drain pump case which is integrally formed with an inner side of the sump case; and a drain pump cover detachably coupled to the drain pump case at an inside the sump case, wherein the drain pump case and drain pump cover form a housing to protect the drain impeller, wherein the drain pump cover includes an impeller covering portion covering the drain impeller and a drain guiding portion configured to guide a flow of wash liquid to the drain impeller, wherein the drain guiding portion includes an inlet through which wash liquid in the wash liquid reservoir flows into the drain pump and a valve selectively opening the inlet, the valve being coupled to the inlet, wherein the drain pump cover is configured to be detachable from the drain pump case together with the valve, and wherein the drain pump cover covers the drain impeller without the drain impeller passing through the drain pump cover.

2. The dishwasher according to claim 1, wherein the drain guiding portion has open portions at a top and bottom thereof, and the open portion at the bottom is sealed by the drain pump case when the drain pump cover is coupled to the drain pump case.

3. The dishwasher according to claim 1, wherein the drain pump cover is engaged with the drain pump case.

4. The dishwasher according to claim 3, wherein the drain pump cover and the drain pump case are engaged at respective stepped portions thereof.

5. The dishwasher according to claim 1, wherein the drain pump case is formed on an inner undersurface of the sump case, and the drain pump cover is coupled at a top of the drain pump case.

6. A dishwasher comprising:

a sump case having a drain pump case, the drain pump case being integrally formed with an inner surface of the sump case;

a wash pump configured to pump wash liquid;

a wash motor configured to drive the wash pump;

a drain impeller draining wash liquid from within the sump case;

a drain motor driving the drain impeller, the drain motor being provided separately from the wash motor; and a covering member selectively coupled to the drain pump case to cover the drain impeller at an inside of the sump case, wherein the covering member includes:

an impeller covering portion covering the drain impeller; and a drain guiding portion guiding a flow of wash liquid to the drain impeller, wherein the drain guiding portion includes an inlet configured to induce wash liquid in the sump case to flow to the drain impeller, a valve selectively opening the inlet downstream of the inlet, and at least one coupling rib to which the valve is coupled, wherein the covering member cover covers the drain impeller without the drain impeller passing through the covering member, and wherein the covering member is configured to be detachable from the drain pump case together with the valve.

7. A dishwasher comprising:

a sump case defining a wash liquid reservoir;

a wash pump configured to pump wash liquid;

a wash motor configured to drive the wash pump;

a drain pump provided at a side of the sump case to drain wash liquid; and a drain motor configured to drive the drain pump, the drain motor being provided separately from the wash motor, wherein the drain pump includes:

a drain impeller inducing a flow of wash liquid;

a drain pump cover detachably mounted on the sump case to facilitate cleaning of the impeller and an inside of drain pump; and a drain pump case integrally formed with an inner surface of the sump case, the drain pump cover being mounted on the drain pump case at an inside of the sump case, wherein the drain pump case has a first coupling portion having a stepped portion and the drain pump cover has a second coupling portion having a stepped portion corresponding to the stepped portion of the first coupling portion, wherein the drain pump cover covers the drain impeller without the drain impeller passing through the drain pump cover, and wherein the drain pump cover is configured to be detachable from the drain pump case together with a valve.

8. The dishwasher according to claim 7, wherein the drain pump cover comprises:

an impeller covering portion covering the drain impeller, and a drain guiding portion guiding a flow of wash liquid to the drain impeller.

9. The dishwasher according to claim 7, wherein the drain pump cover comprises:

an inlet through which wash liquid in the wash liquid reservoir enters the wash pump, and the valve is a check valve selectively opening the inlet and coupled to the drain pump cover.

* * * * *